United States Patent [19]

Fujita et al.

[11] Patent Number: 4,550,633

[45] Date of Patent: Nov. 5, 1985

[54] POWER TIGHTENING DEVICE HAVING DETACHABLE SOCKET UNIT

[75] Inventors: Masahiro Fujita, Sennan; Yukio Uemura, Yokohama, both of Japan

[73] Assignees: Maeda Metal Industries Ltd., Osaka; Nissan Motor Co., Ltd., Kanagawa, both of Japan

[21] Appl. No.: 624,549

[22] Filed: Jun. 26, 1984

[30] Foreign Application Priority Data

Jun. 27, 1983 [JP] Japan ..... 58-99788[U]

[51] Int. Cl.[4] ..... B25B 17/00

[52] U.S. Cl. ..... 81/56

[58] Field of Search ..... 81/56, 55

[56] References Cited

U.S. PATENT DOCUMENTS 1,343,667 6/1920 Evensen ..... 81/56

2,928,302 3/1960 Owen et al. ..... 81/56

3,331,269 7/1967 Santer ..... 81/56

4,403,529 9/1983 Ikeda et al. ..... 81/56

*Primary Examiner*—James L. Jones, Jr.

[57] ABSTRACT

A power tightening device having a unit of inner socket with a bolt tip engaging bore and outer socket with a nut engaging bore which unit can be attached to and removed from the main body of the device. The inner socket is engageable with or disengageable from a planet gear support frame axially thereof and is rotatable therewith. The device includes a holder main body concentrically formed with a non-circular hole and rotatably fitted in the front end of an inner gear case, and a bearing plate disposed on the inner side of the holder main body rotatably with the gear case and concentrically formed with a non-circular hole identical with the hole in shape. The outer socket has a flange conforming to the shape of the holes of the holder main body and the bearing plate. The holder main body is provided with an engaging member for softly holding the holder main body to the bearing plate.

4 Claims, 7 Drawing Figures

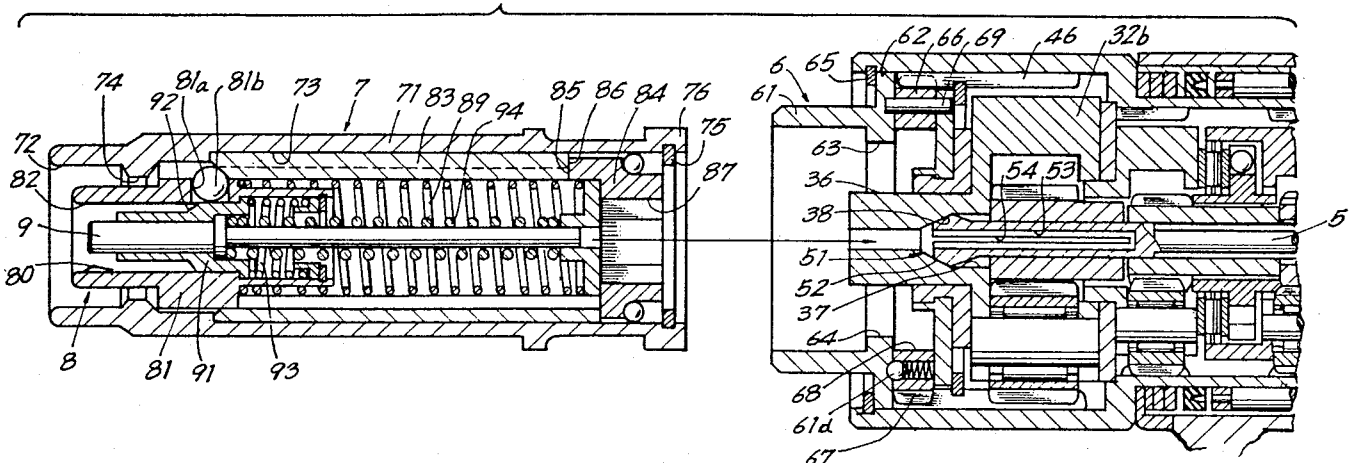
FIG. 5
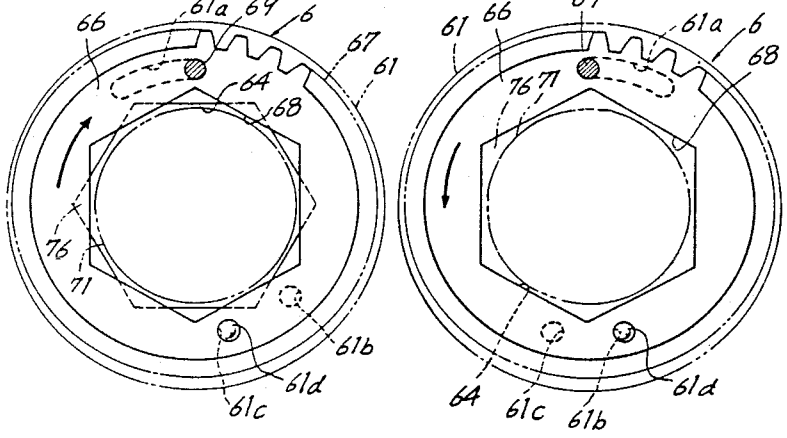
FIG. 4A
FIG. 4B
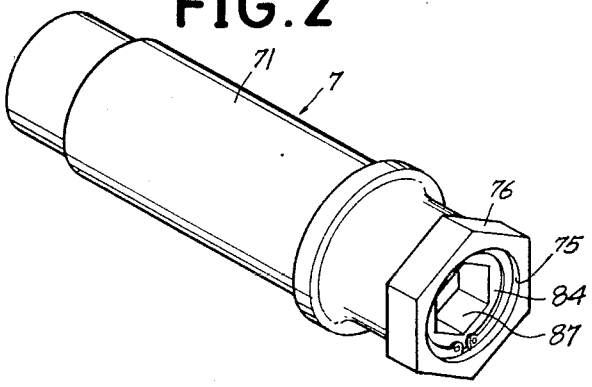
FIG. 2

POWER TIGHTENING DEVICE HAVING DETACHABLE SOCKET UNIT

TECHNICAL FIELD

The present invention relates to a power-operated tightening device. More particularly, the invention relates to improvements in a power tightening device which comprises two concentric sockets, i.e. an outer socket engageable with a nut and an inner socket engageable with a tip at the forward end of a nut and in which the reaction of the rotation for tightening up the nut is equilibrated with a force for holding the bolt tip.

BACKGROUND ART

Tightening devices of this type usually comprises an epicyclic train coupled to a drive assembly and having a planet gear support frame and an inner gear. An inner socket and an outer socket are connected to the frame and the gear, respectively, such that a nut is tightly screwed on a bolt by the reaction of rotation acting on the two sockets.

However, bolts and nuts of specific size only can be tightened up by one device, so that in order to handle bolts and nuts of various sizes, it is necessary to prepare a plurality of tightening devices which are different in socket size or to disassemble the socket attaching portion for replacement.

SUMMARY OF THE INVENTION

An object of the present invention is to provide a power tightening device having a unit of inner socket and outer socket which can be easily attached to and removed from the main body of the device.

The power tightening device of the present invention comprises an inner socket formed with a cavity at its base end, a planet gear support formed with a projection, the inner socket being engageable with or disengageable from the support frame axially thereof and rotatable therewith, a holder main body formed with a non-circular hole concentrically therewith and rotatably fitted in the front end of a inner gear case, a bearing plate disposed on the inner side of the holder main body rotatably with the gear case and concentrically formed with a non-circular hole identical with the hole of the main body in shape, and an outer socket provided with a non-circular flange conforming to the shape of the holes of the main body and the bearing plate, the holder main body being provided with an engaging member for softly holding the main body to the bearing plate in a position where the hole of the main body is out of phase with the hole of the bearing plate.

The flange of the outer socket having the inner socket fitted therein is fitted in the hole of the bearing plate through the hole of the holder main body to engage the projection of the support frame in the cavity of the inner socket. Next, the holder main body is slightly rotated to bring the hole of the holder main body out of phase with the flange of the outer socket. This permits the rotation of the support frame to be transmitted to the inner socket, and the rotation of the gear case to the outer socket, without allowing the sockets to slip off the device main body. Furthermore, the engaging member acting on the holder main body prevents the sockets from inadvertently slipping off even when the hole of the holder main body spontaneously comes into phase with the flange of the outer socket.

BRIEF DESCRIPTION OF THE DRAWINGS

FIG. is an overall sectional view showing a tightening device of the present invention;

FIG. 2 is a perspective view showing a socket unit embodying the invention;

FIGS. 4A and 4B are views illustrating how the socket unit is attached to the main body of the device;

FIG. 5 is a view in section showing the socket unit as separated from its holder.

DETAILED DESCRIPTION OF THE INVENTION

Figures 1, 6:
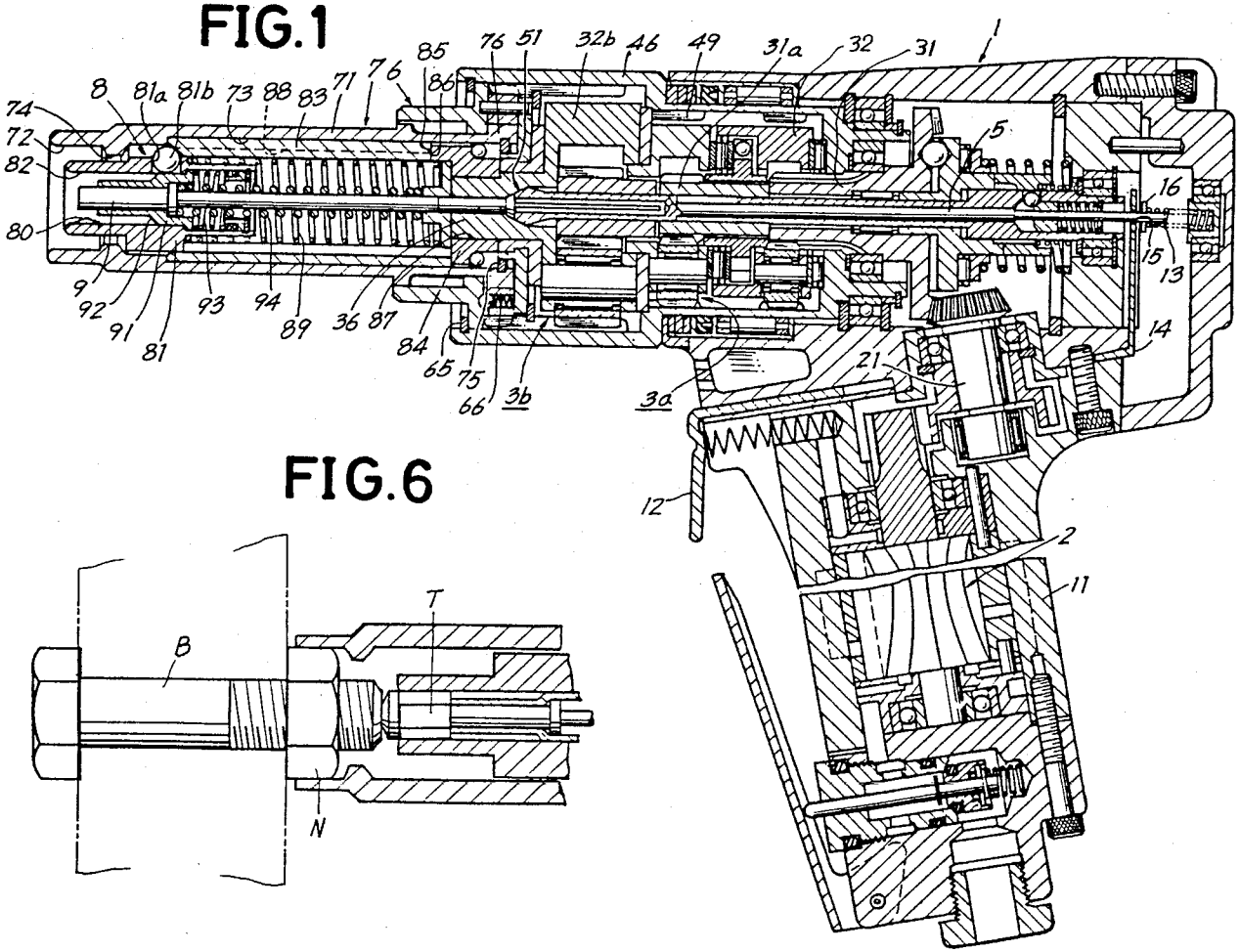
FIG. 6 is a front view showing a bolt and a nut.

The present invention will be described below with reference to the embodiment shown in the drawings.

The tightening device illustrated and embodying the invention is adapted to tighten up a nut N on a bolt B having a tip T to be snapped off from the forward end of its shank as seen in FIG. 6. The tip is snapped off when subjected to a fastening or tightening force in excess of a predetermined torque. Thus the bolt and nut can be tightened up properly with the predetermined torque.

The tightening device comprises a housing 1 including a grip portion 11, a drive assembly 2, such as an air motor, housed in the grip portion 11, a speed change assembly 4 provided in the housing 1 and having an output portion projecting outward from the forward end of the housing 1, and a socket unit 7 removably connected to the speed change assembly 4 and including an inner socket 8 and an outer socket 71 engageable with the tip T of the bolt B and the nut N, respectively.

The main components of the tightening device will be described below in detail.

Speed change essembly

The speed change assembly 4 comprises first, second and third epicyclic trains 3, **3*a* and 3*b* connected in series with one another and housed in a tubular inner gear case 46 which is rotatably fitted in the forward end opening of the housing 1 to give three reduced speeds from the rotation of the drive assembly 2 delivered from a transmission shaft 21**.

The first epicyclic train 3 includes a sun gear 31 rotatable by the rotation of the transmission shaft 21 and a planet gear support frame 32 coupled to the sun gear **31*a* of the second epicyclic train 3*a*. The output rotation of the support frame of the train 3*a* is delivered to the third train 3*b*. Thus the rotation of the shaft 21** is successively subjected to speed reduction.

The planet gear support frame **32*b* of the third epicyclic train 3*b* is formed with an engaging projection 36 at the center of its front end. A socket holder 6 is fitted in the inner gear case 46. When the socket unit 7 is fitted in the holder 6, the inner socket 8 is joined to the engaging projection 36, while the outer socket 71 is coupled to the gear case 46, whereby the output of the speed change assembly 4** is delivered to the sockets.

A clamp shaft 5 extends through the sun gears and the support frames of the first to third epicyclic trains centrally axially thereof. The clamp shaft 5 has a diametrically enlarged front end to provide a clamp portion 51 opposed to the ejector pin 9 to be described later. The shaft 5 has a rear end of reduced diameter which has a trigger lever 12 connected thereto and is biased forward by a spring 13.

The lever 12 is formed from a metal strip by bending, bent in an arcuate form within the grip portion 11 to clear the transmission shaft 21 and further bent upward to provide a base end. The clamp shaft 5 extends through a hole 15 formed in the upper end of the bent portion 14.

The clamp shaft 5 is provided with a snap ring 16, which engages with the lever 12 when the lever 12 is pulled.

Socket holder

Figure 3:
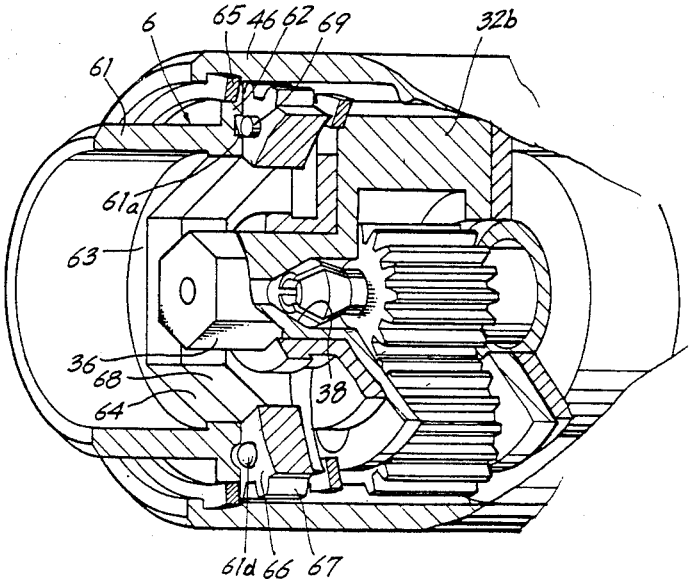
FIG. 3 is a perspective view showing the base end of the socket unit.

As seen in FIGS. 3 and 5, the socket holder 6 comprises a main body 61 formed with outer and inner flanges 62 and 63 at its rear end. The rear end of the holder main body 61 is fitted in the inner gear case 46 independently of the rotation of the gear case. The holder main body 61 is prevented from slipping off from the tubular gear case 46 by snap ring 65.

An annular bearing plate 66 having a toothed outer periphery 67 is in mesh with the toothed surface of the tubular inner gear case 46 and is slidably in contact with the flanges 62 and 63 of the socket holder 6. As seen in FIG. 4A, the bearing plate 66 is concentrically formed with a hexagonal hole 68, while the inner periphery of the inner flange 63 of the socket holder 6 is so shaped as to define a hexagonal hole 64 in match with the hexagonal hole 68 of the bearing plate 66.

A stopper pin 69 projecting from the bearing plate 66 is slidably fitted in a circular arc groove 61*a* formed in the rear end face of the holder 6 on a circle centered about the axis of the holder. The groove 61*a* has a length equal to 1/12 of the circumference of the circle. The bearing plate 66 is rotatable relative to the holder through an angle subtended by the circular arc of the groove.

The holder main body 61 is retained on or softly engaged with the bearing plate 66 by an engaging member. According to the present embodiment, the engaging member is a spring-biased click ball 61*d* which is disposed on the bearing plate 66 at a location away from the stopper pin 69. Two conical cavities 61*b* and 61*c* are formed in the flange end face of the socket holder 6 for two positions of the click ball 61*d* which correspond to opposite ends of the circular arc groove 61*a* where the stopper pin 69 is to be positioned. The socket holder 6 is softly held to the bearing plate 66 by the engagement of the click ball 61*d* in one of the conical cavities 61*b* and 61*c*. Thus the holder 6 is softly held to the plate 66 with the hexagonal holes 68 and 64 of the bearing plate 66 and the socket holder 6 in or out of phase with each other.

Socket unit

The socket unit 7 comprises the outer socket 71, inner socket 8 and ejector pin 9 and is removably attached to the socket holder 6.

As shown in the left section of FIG. 5, the inner socket 8 is rotatably fitted in the outer socket 71 coaxially therewith and prevented from slipping off from the outer socket 71 by an inner flange 74 on the outer socket close to its front end and by a snap ring 75 at the rear end of the outer socket.

The inner socket 8 comprises an inner tube 83, an inner socket main body 81 splined to the forward end inner surface of the inner tube 83 so as to be slidable axially thereof and rotatable therewith and a transmission tube 84 provided at the base end of the inner tube 83.

The outer socket 71 has a nut engaging bore 72 at its front end and is formed at its base end with a hexagonal flange 76 which is removably fitted in the hexagonal holes 64 and 68 of the holder main body 61 and the bearing plate 66.

The inner tube 83 and the transmission tube 84 have toothed ends 85 and 86 opposed to and meshing with each other.

The tube 84 coaxially formed with a hexagonal cavity 87 having removably engaged therein the engaging projection 36 of the support frame 32*b* of the third epicyclic train 3*b*.

The inner socket main body 81 is formed in its front end with a tip engaging bore 82 for the bolt tip T to engage in and is biased forward by a spring 89. The engaging bore 82 is provided with a plate spring 80 for preventing the bolt tip T from spontaneously falling off after the tip T has been snapped off. The force of the spring 80 is such that the spring can retain the bolt tip against gravity while permitting the discharge of the tip without trouble as will be described later.

The inner socket 8 is provided with known incomplete fitting prevention means.

To provide the prevention means, a hole 81*a* is formed in the tubular wall of the inner socket main body 81. A ball 81*b* rollably fitted in the hole 81*a* has such a size as to project outward from the tubular wall. A tip insertion recognizing tube 91 is slidably fitted in the inner socket 8.

The insertion recognizing tube 91 has a small-diameter front portion and a large-diameter rear portion, with a tapered stepped portion 92 formed therebetween, and is biased toward the front end of the outer socket 71 by a spring 93. The ball 81*b* is pushed up outward by the large-diameter portion of the tube 91 into contact with the front end of the inner tube 83, whereby the inner socket main body 61 is prevented from retraction.

The ejector pin 9 of the socket unit 7 slidably extends through the tip insertion recognizing tube 91.

The ejector pin 9 is biased outward by a spring 94 and has a front end projecting beyond the tube 91 and a base end extending toward the cavity 87 of the transmission tube 84.

To attach the socket unit 7 to the holder 6, the hexagonal holes 64 and 68 of the socket holder main body 61 and the bearing plate 66 are registered with each other in phase as seen in FIG. 4A, the hexagonal flange 76 of the outer socket 71 is fitted into the holes 64, 68, and the holder main body 61 is rotated in the direction of arrow shown, whereby the hexagonal flange 76 of the outer socket 71 is brought out of phase with the hexagonal hole 64 in the holder main body 61 as seen in FIG. 4B. This prevents the outer socket 71, accordingly the socket unit 7, from slipping off. Since the spring-biased click ball 61*d* engages in the conical cavity 61*c* of the socket holder main body 61 to softly or moderately engage the holder main body 61, the hexagonal flange 76 of the outer socket 71 will not spontaneously come into phase with the hexagonal hole 64 of the holder main body 61 during tightening, whereby the unit 7 is prevented from slipping off inadvertently.

The clamp portion 51 formed at the front end of the clamp shaft 5 is adapted to releasably support the ejector pin 9.

Clamp portion

The front end of the clamp shaft 5 is formed with a tapered face 53 and fitted in a base-end large-diameter portion of a stepped axial bore 37 extending through the support frame 32*b* of the third epicyclic train.

The stepped portion of the axial bore 37 is defined by a tapered face 38 corresponding to the tapered face 52 of the clamp shaft 5.

The clamp shaft 5 is coaxially formed with an axial bore 53 which is opened at its front end and has slits 54 in communication with the axial bore 53.

The clamp shaft 5 is spring-biased toward the outer socket 71 into contact with the tapered face 38 defining the axial bore 37 of the support frame 32*b*, whereby the axial bore 53 is diametrically contracted.

When the lever 12 is pulled to rearwardly move the clamp shaft 5 against the spring 13 away from the tapered face 38 of the bore 37, the slits 54 and the axial bore 53 are enlarged to permit entry of the ejector pin 9.

The tightening device described above operates in the following manner.

Engagement of nut and bolt

A nut is first loosely screwed on a bolt manually.

With the device placed on the bolt, the bolt tip T is fitted into the tip engaging bore 82.

At this time, the ejector pin 9 and the insertion recognizing tube 91 within the socket 8 retract against the springs 93 and 94. When the bolt tip T has completely fitted into the bore 82, the ball 81*b* of the incomplete fitting prevention means falls from the tapered portion 92 of the tube 91 onto the small-diameter portion, permitting retraction of the inner socket 8 from the nut engaging bore 72 of the outer socket 7. The nut N therefore fits into the bore 72.

At this time, the ejector pin 9 rearwardly pushes the clamp portion 51 of the clamp shaft 5, moving the tapered face 52 of the clamp portion 51 away from the tapered face 38 of the support frame 32*b*. This enlarges the axial bore 53 of the clamp portion 51, allowing the rear end of the ejector pin 9 to advance into the enlarged axial bore 53, whereby the shaft 5 has its tapered face 52 brought into contact with the tapered face 38 of the support frame 32*b* again by the action of the spring 13. Consequently the axial bore 53 is diametrically contracted for the clamp portion 51 to clamp the ejector pin 9.

Tightening

When the drive assembly 2 is operated, the differential gear mechanisms provided by the first to third epicyclic trains 3, 3*a* and 3*b* cause the tubular inner gear case 46 and the support frame 32*b* to produce torques acting in opposite directions. With the bolt tip T held by the inner socket 8, the outer socket 71 rotates the nut N at a relatively high speed to screw the nut on the bolt.

Tightening up and shearing

When the nut is tightly screwed on the bolt, abruptly increasing resistance acts on the rotational drive system to rotate the support frame 32*b* at a reduced speed and produce increased tightening torque, which is delivered to the inner socket 8 and the outer socket 71. At the ultimate stage of bolt-nut tightening, the torque causes stress concentration on the grooved portion C of the bolt for snapping off the tip T, whereby the tip T is sheared. This assures that the nut is tightened up on the bolt with a specified torque vale.

Discharge of tip and return of parts

After tightening up, the cut-off bolt tip T remains in the inner socket 8 as retained by the plate spring 80. When the entire device is moved away from the nut N, the inner socket main body 81 is advanced into the nut fitting portion of the outer socket 71 and returned to its original position by the inner socket spring 89.

At this time, the ejector pin 9 remains in its retracted position as clamped by the clamp portion 51 of the clamp shaft 5.

When the lever 12 is pulled to retract the shaft 5 and move the tapered face 52 of the shaft 5 away from the tapered face 38 of the support frame 32*b*, the axial bore 53 of the shaft 5 enlarges to release the ejector pin 9 from the clamp portion 51, whereupon the ejector pin 9 is forced forward by the spring 94 to throw out the bolt tip T.

To replace the socket unit by another socket unit of different size, the socket holder main body 61 is turned in the direction of arrow shown in FIG. 4B to bring the hole 64 of the holder main body 61 in phase with the hole 68 of the bearing plate 66. The socket unit 7 is now easily removable. The desired unit is then installed in place by the same procedure as already stated.

In practicing the present invention, the flange 76 of the outer socket 71 and the holes 64, 68 of the socket holder main body 61 and the bearing plate 66 can be shaped variously insofar as they have a non-circular shape, such as hexagonal, elliptical or like shape. Further the hole 68 in the bearing plate 66 need not always be formed through the entire thickness thereof in corresponding relation to the flange 76, provided that the bearing plate 66 has a portion for supporting the flange 76 and a hole for connecting the inner socket 8 to the support frame 32*b*. Thus the present embodiment is not limitative but can be modified variously within the scope of the invention defined in the appended claims.

To use the present device for bolts and nuts of the desired size, the socket unit 8 only is easily replaceable by one of a plurality of units 8 of varying socket size which are prepared for bolts and nuts of different sizes, so that there is no need to prepare a plurality of tightening devices conventionally required. For the replacement of unit, the unit can be removed or attached very conveniently merely by rotating the socket holder 6 within the range of the circular arc groove 61*a* in either direction.

What is claimed is:

1. A power tool including an inner socket having a bolt tip engaging bore, an outer socket having a nut engaging bore and the inner socket rotatably fitted therein, and an epicyclic train coupled to a drive assembly and having an inner gear case and a planet gear support frame, the outer socket being coupled to the gear case, the inner socket being connected to the support frame, so as to tightly screw a nut on a bolt by torques acting on the two sockets, the power tool being characterized in that the inner socket is formed with a cavity at its base end, the planet gear support being formed with a projection, the inner socket being engagable with or disengageable from the support frame axially thereof and rotatable therewith, a holder main body being formed with a non-circular hole concentrically therewith and rotatably fitted in the front end of the gear case, a bearing plate being disposed on the inner side of the main body rotatably with the gear case and being concentrically formed with a non-circular hole identical with the hole of the main body in shape, the outer socket being provided with a non-circular flange conforming to the shape of the holes of the main body and the bearing plate, the holder main body being provided with an engaging member for softly holding the main body to the bearing plate in a position where the hole of the main body is out of phase with the hole of the bearing plate.

2. A power tool as defined in claim 1 wherein the flange and the holes are regular polygonal.

3. A power tool as defined in claim 1 wherein the engaging member is a spring-biased click ball provided in one member of the holder main body and the bearing plate and slightly fittable in a conical cavity formed in the other member.

4. A power tool as defined in claim 2 wherein the engaging member is a spring-biased click ball provided in one member of the holder main body and the bearing plate and slightly fittable in a conical cavity formed in the other member.

* * * * *